US006309484B2

(12) United States Patent
Langlotz et al.

(10) Patent No.: US 6,309,484 B2
(45) **Date of Patent: *Oct. 30, 2001**

(54) PROPELLENT CHARGE POWDER FOR BARREL-TYPE WEAPONS

(75) Inventors: Walter Langlotz, Henfenfeld; Dietmar Müller, Karlsruhe, both of (DE)

(73) Assignee: Diehl Stiftung & Co., Nuremberg (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/355,479

(22) PCT Filed: Feb. 6, 1998

(86) PCT No.: PCT/EP98/00639

§ 371 Date: Jul. 30, 1999

§ 102(e) Date: Jul. 30, 1999

(87) PCT Pub. No.: WO98/34891

PCT Pub. Date: Aug. 13, 1998

(30) Foreign Application Priority Data

Feb. 8, 1997 (DE) ..... 197 04 792
Dec. 23, 1997 (DE) ..... 197 57 469

(51) Int. Cl.[7] ..... C06B 45/10; C06B 25/34

(52) U.S. Cl. ..... 149/19.3; 149/19.1; 149/19.8; 149/92

(58) Field of Search ..... 149/19.8, 88, 19.6, 149/19.7, 19.1, 92, 96, 19.3

(56) References Cited

U.S. PATENT DOCUMENTS 3,697,341 10/1972 Rosher et al. ..... 149/92
4,002,514 * 1/1977 Plomer et al. ..... 149/19.4
4,085,123 * 4/1978 Flanagan et al. ..... 149/92
4,216,039 * 8/1980 Pierce ..... 149/19.4
4,432,817 * 2/1984 Frankel et al. ..... 149/92
4,457,791 * 7/1984 Gill et al. ..... 149/19.3
4,476,322 * 10/1984 Chang et al. ..... 564/109
4,482,404 * 11/1984 Witucki et al. ..... 149/92
4,567,296 1/1986 Adams, Jr. et al. ..... 564/111
4,761,250 * 8/1988 Frankel et al. ..... 149/92
5,053,087 * 10/1991 Flanagan et al. ..... 149/92
5,186,770 * 2/1993 Adams, Jr. et al. ..... 149/92
5,482,581 * 1/1996 Urenovitch ..... 149/92
5,529,649 * 6/1996 Lund et al. ..... 149/19.3
5,587,553 * 12/1996 Braithwaite et al. ..... 149/92
5,596,168 * 1/1997 Menke et al. ..... 149/19.4
5,695,216 * 12/1997 Sandstrom et al. ..... 280/737
5,798,481 * 8/1998 Manning et al. ..... 149/19.8

FOREIGN PATENT DOCUMENTS

WO 95/17358 4/1995 (WO) .

* cited by examiner

*Primary Examiner*—Charles T. Jordan
*Assistant Examiner*—Aileen J. Baker
(74) *Attorney, Agent, or Firm*—Scully, Scott, Murphy & Presser

(57) ABSTRACT

A propellent charge powder for barrel-type weapons having a plasticizer on the basis of nitramine and nitrocellulose, nitramine and energetic and non-energetic plastic binders, or nitrocellulose or an explosive, and wherein the plasticizer is a mixture of at least two chemically different dinitro diaza compounds. The plasticizer facilitates the production and use of the propellent charge powder possessing a low temperature coefficient.

11 Claims, 1 Drawing Sheet

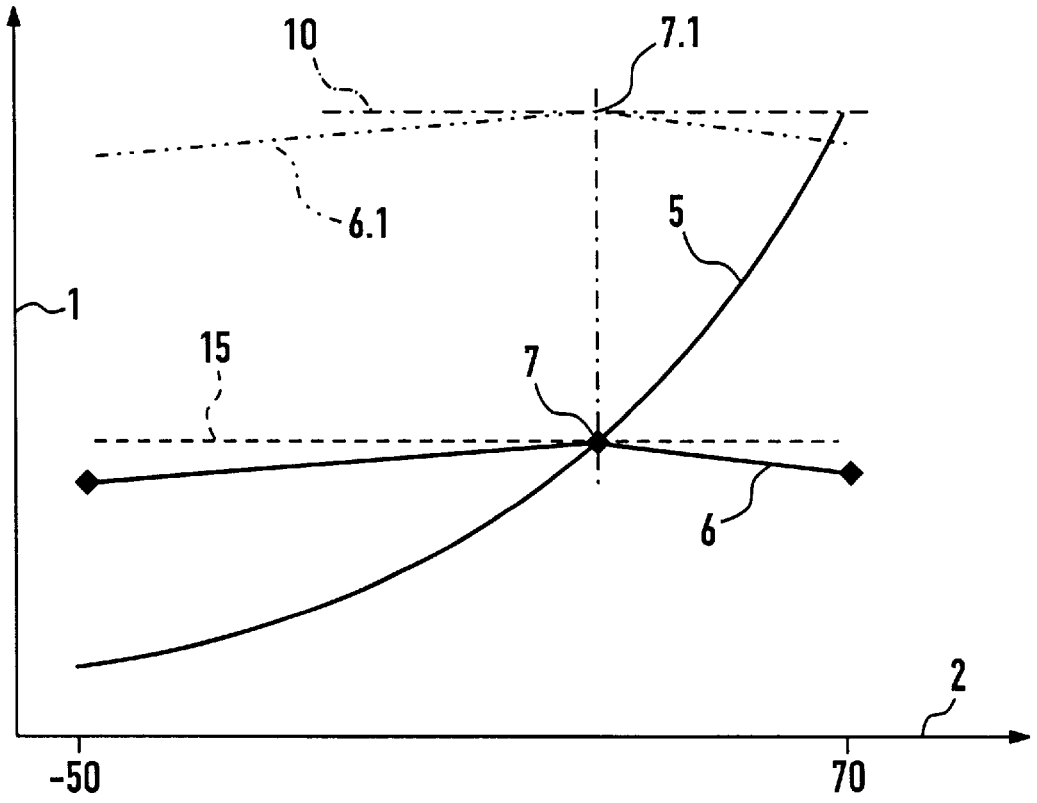
10
7.1
6.1
5
1
15
7
6
2
-50
70

PROPELLENT CHARGE POWDER FOR BARREL-TYPE WEAPONS

BACKGROUND OF THE INVENTION

1. Field of the Invention

The invention relates to a propellent charge powder for barrel-type weapons having a plasticizer on the basis of nitramine and nitrocellulose, nitramine and energetic and non-energetic plastic binders, or nitrocellulose, or an explosive.

2. Discussion of the Prior Art

DE 35 00 068 C1 concerns a monobasic or polybasic propellent charge powder using O,O'-dioxy azobenzene for the purposes of improving mechanical properties at down to −55° C. No information is given about temperature coefficients. In addition no diaza compound is used.

DE 33 16 676 C2 describes a propellant composition based on nitrocellulose with hexogen, a blasting oil and plasticiser or softener as well as nitroglycerine. No mention is made of a diaza compound however and there is also no information about temperature coefficients.

DE 30 33 519 C2 concerns a rocket propellant for a usually low pressure range upon combustion. No information is given about the pressure range which is relevant for propellent charge powder of over 3000 bars. Admittedly, some indications are afforded in regard to mechanical properties in a wide temperature range. There is however no information about temperature coefficients, dependency of the gas pressure on the temperatures of the propellent charge powder. The energetic plasticiser or softener is blasting oil such or Ngl but no diaza compound.

A further known propellent charge powder as disclosed in DE 22 60 259 A involves a propellant composition for rockets and not a propellent charge for barrel-type weapons. That propellent charge, like generally all dibasic propellants, is heavily temperature-dependent in the temperature range which is of interest.

U.S. Pat. No. 4,567,296 A describes an energetic plasticiser or softener on the basis of a fluorine-bearing aza compound. That aza compound, more specifically 1-fluoro-1,1,5-trinitro-3-oxa-5-azahexane is not suitable for use in barrel-type weapons and propellent charge powders. Upon combustion in a weapon, the steel is destroyed, particularly at the usually high pressures and temperatures. In addition that compound gives rise to a major disposal problem. The starting material 2-nitro-2-aza-1 propanol is chemically basically different from a diaza compound.

Upon firing munitions with conventional propellent charge powder, the ballistic values maximum pressure and projectile velocity are also heavily temperature-dependent. The pressure and the velocity of 120 mm KE-munition rise from −40° C. to +50° C. by about 1500 bars and 165 m/s, that is to say 10% of the reference or target speed at normal temperature of +21° C. On the basis thereof, on the one hand the armament operational gas pressure cannot be fully utilised at normal temperature, which would result in a high velocity, and on the other hand, because of the only inaccurately known current initial projectile velocity the hit probability is markedly reduced or measures must be taken to ascertain the current projectile velocity in order not to suffer a loss in terms of hit accuracy.

SUMMARY OF THE INVENTION

The object of the present invention is to propose a propellent charge powder for barrel-type weapons, which has a low temperature coefficient in the temperature range of −50° C. to +70° C.

The invention attains the foregoing object in that the plasticizer comprises a mixture of at least two chemically different dinitro diaza compounds.

By virtue of the use of a particular plasticiser or softener the invention makes it possible to produce and use propellent charge powder with a low temperature coefficient. In other words: a propellent charge powder of that kind makes it possible to fire armament munition with almost dibasic propellants, is heavily temperature-dependent in the temperature range which is of interest.

BRIEF DESCRIPTION OF THE ACCOMPANYING DRAWING

U.S. Pat. No. 4,567,296 A describes an energetic plasticiser or softener on the basis of a fluorine-bearing aza compound. That aza compound, more specifically 1-fluoro-1,1,5-trinitro-3-oxa-5-azahexane is not suitable for use in barrel-type weapons and propellent charge powders. Upon combustion in a weapon, the steel is destroyed, particularly at the usually high pressures and temperatures. In addition that compound gives rise to a major disposal problem. The starting material 2-nitro-2-aza-1 propanol is chemically basically different from the dinitro diaza compounds according to the invention.

A better plasticisable propellent charge powder, in accordance with U.S. Pat. No. 4,457,791, is based on a plasticiser DMMD. Further plasticisers as additives to that specified are not provided. There is no indication that the temperature coefficient upon combustion is positively influenced.

Transformation or the gas-generation rate of conventional monobasic and polybasic propellent charge powders is highly temperature-dependent. The greater the initial powder temperature, that much faster is combustion of the propellent charge powder. That property is substance-specific and can be described for example to a good degree of approximation by the combustion law as follows:

$$\gamma = \beta \cdot \left(\frac{p}{p_o}\right)^{\alpha} \cdot e^{\tau T}$$

with T as the temperature of the propellent charge powder. In that equation $\tau$ denotes the so-called temperature coefficient of the propellent charge powder, which is of different values for the various powder compositions and which represents a substance constant. In addition $\gamma$ denotes the velocity with which the combustion front progresses, $\beta$ and $\alpha$ represent substance constants and p is the pressure under which the propellent charge powder is, wherein $p_o$ is atmospheric pressure.

As a result of the temperature-dependency of the combustion speed of the propellent charge powder, the maximum gas pressure which occurs when firing munition with conventional monobasic and polybasic propellent charge powder from an armament, in the charge chamber of the weapon, and thus also the projectile launch velocity are also severely temperature-dependent.

The pressure and the velocity of 120 mm KE-munition rise from −40° C. to +50° C. by about 1500 bars and 165 m/s, that is to say 10% of the reference or target speed at normal temperature of +21° C. On the basis thereof, on the one hand the armament operational gas pressure cannot be fully utilised at normal temperature, which would result in a high velocity, and on the other hand, because of the only inaccurately known current powder temperature and thus the initial projectile velocity the hit probability is markedly reduced or measures must be taken to ascertain the current projectile velocity in order not to suffer a loss in terms of hit accuracy.

The object of the present invention is to propose a propellent charge powder for barrel-type weapons, which has a low temperature coefficient in the temperature range of −50° C. to +70° C. so that in that way the specified ballistic values of maximum pressure and projectile velocity depend only slightly on the powder temperature.

The invention attains that object in accordance with the characterising features of claim 1. Advantageous developments of the invention are set forth in the appendant claims.

By virtue of the use of a particular plasticiser or softener the invention makes it possible to produce and use propellent charge powder with a low temperature coefficient. In other words: a propellent charge powder of that kind makes it possible to fire armament munition with almost constant values in respect of maximum pressure and projectile velocity in the entire temperature range of −50° C. to +70° C.

Embodiments of the invention are set out hereinafter, a diagram illustrating the temperature characteristics of a conventional propellent charge powder and a propellent charge powder according to the invention.

The invention concerns the following propellent charge powders:

glycidyl azide polymer (GAP), hydroxy-terminated polybutadiene (HTPB), polybutadiene with terminal hydroxyl groups and cellulose acetate butyrate (CAB)

bound nitramine propellent charge powders with the dinitro diaza plasticiser mixture according to the invention and nitrocellulose propellent charge powders. NC, which comprise nitramines, nitrocellulose and dinitro diaza plasticiser or nitrocellulose and dinitro diaza plasticiser with or without blasting oil such as nitroglycerine (Ngl) or diglycol dinitrate (DEGN).

2,4-Dinitro-2,4-diazahexane 45±10% by weight 3,5-Dinitro-3,5-diazaheptane 15±15% by weight The diagrammatically illustrated graph sets out the pressure configuration on the orinate 2 when the weapon is fired in relation to the temperature on the abscissa 1.

In the case of a propellent charge powder in accordance with the state of the art the pressure changes very severely in the specified temperature range of −50° C. to +70° C. in accordance with the rising curve 5.

In comparison the pressure remains almost constant as indicated by the curve 6 in the specified temperature range. The curve 6 initially rises and then falls somewhat from the reversal point 7. The optimum is an almost horizontal configuration corresponding to the curve 15.

If the propellent charge powder in accordance with the invention is altered by conventional measures such as altering the grain geometry in such a way that the original curve 6 lies as curve 6.1 with its reversal point 7.1 against the pressure limit 10, that denotes a considerable increase in power or performance of 10 to 20% with respect to the usual propellent charge powder as indicated by curve 5.

What is claimed is:

1. A gun propellant composition comprising:

an explosive charge powder; and

2–55%, by weight, based on the total weight of said gun propellant composition, of a liquid plasticizer comprising a mixture of at least two chemically different dinitro diaza hydrocarbons selected from the group consisting of dinitro diaza alkanes, dinitro diaza alkenes, dinitro diaza alkynes and mixtures thereof, wherein said gun propellant composition has a low temperature coefficient in the range of −50° to 70° C.

2. The gun propellant composition of claim 1 wherein said explosive charge powder is selected from the group consisting of solid nitramine and nitrocellulose; solid nitramine and an energetic or non-energetic plastic binder; nitrocellulose; and other explosives besides a solid nitramine.

3. The gun propellant composition of claim 2 wherein said solid nitramine is selected from the group consisting of hexogen nitramine and octogen nitramine.

| | PCP-formulation % by weight | | | | | | |
|---|---|---|---|---|---|---|---|
| RDX or HMX | 70 ± 15 | 70 ± 15 | 70 ± 15 | 40 ± 15 | 60 ± 20 | | 40 ± 15 |
| Plasticiser DNDA-mix (3 components) | 10 ± 8 | 10 ± 8 | 15 ± 10 | 30 ± 25 | 20 ± 12 | 30 ± 25 | |
| GAP with isocyanate | 20 ± 5 | | | | | | |
| GAP without isocyanate | | | | | | | 30 ± 20 |
| HTPB with isocyanate | | 20 ± 5 | | | | | |
| CAB | | | 15 ± 5 | | | | |
| NC + stick | | | | 30 ± 5 | 20 ± 12 | 70 ± 25 | 30 ± 15 |
| blasting oil | | | | | | 0 ± 40 | |

The abbreviations RDX=hexogen and HMX=octogen, while PCP is used to mean propellent charge powder.

With nitratoethyl nitramine (NENA), poly-3-nitratomethyl-3'-methyloxetan (PolyNIMMO) and polyglycidyl nitrate ester (Polyglyn) as energetic polymer binder, a comparable temperature behaviour occurs insofar as the plasticiser according to the invention is used in the above-specified quantitative proportion. In the case of Polyglyn the azide group of GAP is replaced by —O—$NO_2$.

The dinitro diaza plasticiser comprises the following components:

2,4-Dinitro-2,4-diazapentane 40±10% by weight

4. The gun propellant composition of claim 1 further comprising stabilizers or a combination of stabilizers and combustion moderators.

5. The gun propellant composition of claim 2 wherein said energetic plastic binders are selected from the group consisting of methyl-nena, ethyl-nena and butyl-nena.

6. The gun propellant composition of claim 2 wherein said energetic plastic binders are selected from the group consisting of poly-3-nitratomethyl-3-methyloxetan (PolyNIMMO), poly-glycidyl nitrate ester (Polyglyn), glycidyl azide polymer (GAP), poly-3-azidomethyl-3'-methyloxetan (AMMO), poly-3,3'-bis-azidomethyloxetan (BAMO) and mixtures thereof.

7. The gun propellant composition of claim 2 wherein said non-energetic plastic binders are selected from the group consisting of polybutadienes with terminal hydroxyl groups (HTPB), cellulose acetate butyrate (CAB) and mixtures thereof.

8. The gun propellant composition of claim 2 wherein said other explosives are selected from the group consisting of 1,3,3-trinitroazetidine (TNAZ), ammonium dinitramide (ADN), triaminoguanidine nitrate (TAGN), hexanitro-hexa-aza-iso-wurzitan (CL-20) and mixtures thereof.

9. The gun propellant composition of claim 2 wherein said other explosives are blasting oils.

10. The gun propellant composition of claim 1 wherein said plasticizer comprises a mixture of:

40±10%, by weight, 2,4-Dinitro-2,4-diazapentane;

45±10%, by weight, 2,4-Dinitro-2,4-diazahexane;

15±10%, by weight, 3,5-Dinitro-3,5-diazaheptane.

11. A gun propellant composition comprising:

an explosive charge powder wherein said explosive charge powder is selected from the group consisting of solid nitramine and nitrocellulose; solid nitramine and an energetic or non-energetic plastic binder; nitrocellulose; and other explosives besides a solid nitramine; and 2–55%, by weight, based on the total weight of said gun propellant composition, of a liquid plasticizer comprising a mixture of at least two chemically different dinitro diaza hydrocarbons selected from the group consisting of dinitro diaza alkanes, dinitro diaza alkenes, dinitro diaza alkynes and mixtures thereof, wherein said gun propellant composition has a low temperature coefficient in the range of −50° to 70° C.

* * * * *